US011828439B2

(12) United States Patent
Chen

(10) Patent No.: US 11,828,439 B2
(45) Date of Patent: Nov. 28, 2023

(54) SPLIT TYPE SINGLE-BUCKLE LAMP

(71) Applicant: Dongguan LianRun Lighting Co., Ltd., Dongguan (CN)

(72) Inventor: Kunpeng Chen, Dongguan (CN)

(73) Assignee: Dongguan LianRun Lighting Co., Ltd., Dongguan (CN)

( * ) Notice: Subject to any disclaimer, the term of this patent is extended or adjusted under 35 U.S.C. 154(b) by 0 days.

(21) Appl. No.: 18/336,963

(22) Filed: Jun. 17, 2023

(65) Prior Publication Data

US 2023/0332760 A1 Oct. 19, 2023

(30) Foreign Application Priority Data

May 31, 2023 (CN) ..... 202321357902.1

(51) Int. Cl.
*F21V 17/16* (2006.01)
*F21V 23/06* (2006.01)
*F21S 4/10* (2016.01)

(52) U.S. Cl.
CPC ..... *F21V 17/164* (2013.01); *F21S 4/10* (2016.01); *F21V 23/06* (2013.01)

(58) Field of Classification Search
CPC ..... F21V 17/164; F21V 23/06; F21S 4/10
See application file for complete search history.

(56) References Cited

U.S. PATENT DOCUMENTS

| | | | | |
|---|---|---|---|---|
| 5,738,436 | A * | 4/1998 | Cummings | F21V 25/00 362/148 |
| 2020/0132281 | A1* | 4/2020 | Huang | F21V 21/002 |
| 2021/0341137 | A1 | 11/2021 | Zhang et al. | |
| 2022/0074563 | A1 | 3/2022 | Shimizu | |
| 2022/0299198 | A1 | 9/2022 | Feng et al. | |

* cited by examiner

*Primary Examiner* — Mary Ellen Bowman
(74) *Attorney, Agent, or Firm* — Zhigang Ma

(57) ABSTRACT

The present disclosure relates to the technical field of lamps, and discloses a split type single-buckle lamp. The split type single-buckle lamp includes an inner lamp holder, and a bulb in threaded connection with the inner lamp holder; the inner lamp holder is connected with a live conductor wire; a split type outer lamp holder sleeves the inner lamp holder; the outer lamp holder includes a first housing and a second housing which are buckled with each other. Furthermore, the first housing and the second housing are connected in a single-buckle manner, so that the outer lamp holder is replaceable and has high flexibility. The single-buckle design effectively improves the assembling efficiency of the outer lamp holder.

10 Claims, 6 Drawing Sheets

SPLIT TYPE SINGLE-BUCKLE LAMP

TECHNICAL FIELD

The present disclosure relates to the technical field of lamps, in particular to a split type single-buckle lamp.

BACKGROUND

With the development of science and technology, various types of lamps are constantly appearing. An outdoor lamp, as one type, is a lighting lamp exposed for outdoor use. The outdoor lamp can usually be combined with surrounding roads, landscapes, and buildings for lighting design and mounting, to achieve the unity of its function and artistry, and achieve effects of large-area lighting and decoration in surrounding regions.

Chinese patent No. CN202220806100.3 discloses a lamp with an improved bulb fitting structure, including a lamp holder and a bulb connected to the lamp holder. The lamp holder includes an inner lamp holder and an outer lamp holder; the bulb is connected to the inner lamp holder; and the inner lamp holder is nested inside the outer lamp holder. Although the inner lamp holder is nested inside the outer lamp holder in the prior art, which allows a bulb with a large volume to be connected to a small-sized lamp holder, thereby reducing the power consumption of a string light and saving the use costs, a forming method of the outer lamp holder is direct integrated encapsulation and injection molding outside the inner lamp holder. This connection manner makes it impossible to separate and replace the inner lamp holder and the outer lamp holder. The flexibility of the lamp is low. Once the outer lamp holder of the lamp is damaged, the entire lamp is scrapped. Even if other components are in good conditions, this will lead to a significant increase in the production and use costs of the lamp, which cannot meet the demands of customers. In view of this, the inventor has made a new invention.

SUMMARY

The present disclosure aims to overcome the shortcomings in the prior art and provide a split type single-buckle lamp, which has the characteristics of high flexibility and low cost.

In order to achieve the above objective, the present disclosure discloses a split type single-buckle lamp, including an inner lamp holder, and a bulb in threaded connection with the inner lamp holder; the inner lamp holder is connected with a live conductor wire; a split type outer lamp holder sleeves the inner lamp holder; the outer lamp holder includes a first housing and a second housing which are buckled with each other; a positioning ring for assisting in housing buckling is arranged at an upper end portion of the first housing; a buckling position is arranged in the middle of a lower end of the first housing; a buckling tongue matched with the buckling position is arranged in the middle of a lower end of the second housing; the first housing and the second housing are buckled with each other to form an accommodating position used for accommodating the inner lamp holder, and a wire accommodating channel for allowing the live conductor wire to pass; the split type single-buckle lamp further includes an outer bulb shell; the outer bulb shell sleeves the bulb; and the outer bulb shell is connected to the outer lamp holder.

Preferably, an annular assembling portion is arranged at an upper end of the second housing; and the annular assembling portion is of a structure having a narrow top and a wide bottom.

Preferably, a plurality of groups of first positioning blocks are symmetrically arranged at a side portion of the first housing; and a plurality of first clamping positions matched with the first positioning blocks are arranged at a side portion of the second housing.

Preferably, plug connectors are further arranged on two sides of the buckling tongue; and plugging positions into which the plug connectors are plugged are correspondingly arranged on two sides of the buckling position.

Further, two sides of the first housing outwards extend to form first semicircular slots with openings; two sides of the second housing outwards extend to form second semicircular slots with openings; both the first semicircular slots and the second semicircular slots are communicated with the accommodating position; and the first semicircular slots and the second semicircular slots cooperate with each other to form the wire accommodating channel.

Preferably, a group of second positioning blocks are symmetrically arranged at the first semicircular slots; and a group of second clamping positions matched with the second positioning blocks are correspondingly arranged at the second semicircular slots.

Preferably, a plurality of stoppers used for limiting a position of the inner lamp holder are arranged on an inner wall of the accommodating position.

Preferably, a suspension loop for suspending and positioning the bulb is further arranged at a bottom end of the first housing.

Preferably, the suspension loop partially protrudes out of the first housing, and the second housing is correspondingly provided with a gap used for accommodating the suspension loop.

Preferably, an opening through which the bulb is placed is formed in the accommodating position; a threaded portion is arranged at the end of the accommodating position provided with the opening; and the outer bulb shell is in threaded connection with the outer lamp holder through the threaded portion.

Beneficial effects: Compared with the prior art, the present disclosure is a split type single-buckle lamp, including an inner lamp holder, and a bulb in threaded connection with the inner lamp holder; the inner lamp holder is connected with a live conductor wire; a split type outer lamp holder sleeves the inner lamp holder; and the outer lamp holder includes a first housing and a second housing which are buckled with each other. The present disclosure has the following advantages: 1. The outer lamp holder is of a split type, so that the outer lamp holder is removable and replaceable, has high flexibility, and effectively reduces the use cost. 2. A large-volume bulb can be connected to a small-sized lamp holder, which saves the power consumption of the lamp, saves metal materials for the lamp holder, and reduces the production cost. 3. The outer lamp holder is positioned by the positioning ring at the top end and is assembled by the single buckle at the bottom end, so that the assembling efficiency is high, and the structure is firm.

REFERENCE NUMERALS INCLUDE

Figure 1:
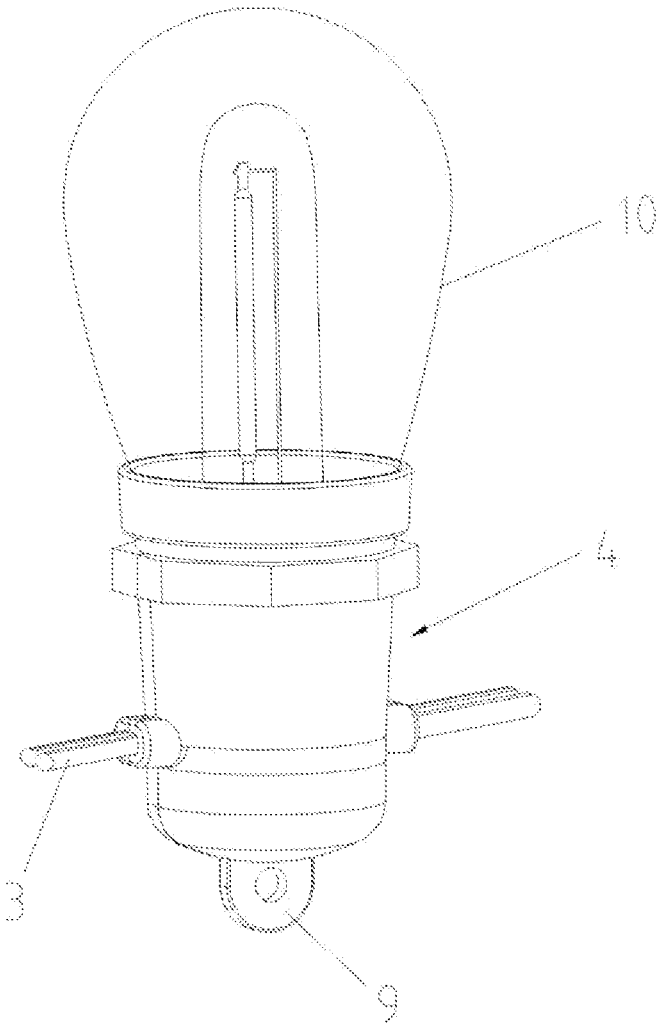
FIG. 1 is a schematic three-dimensional diagram of the present disclosure.
Figure 2:
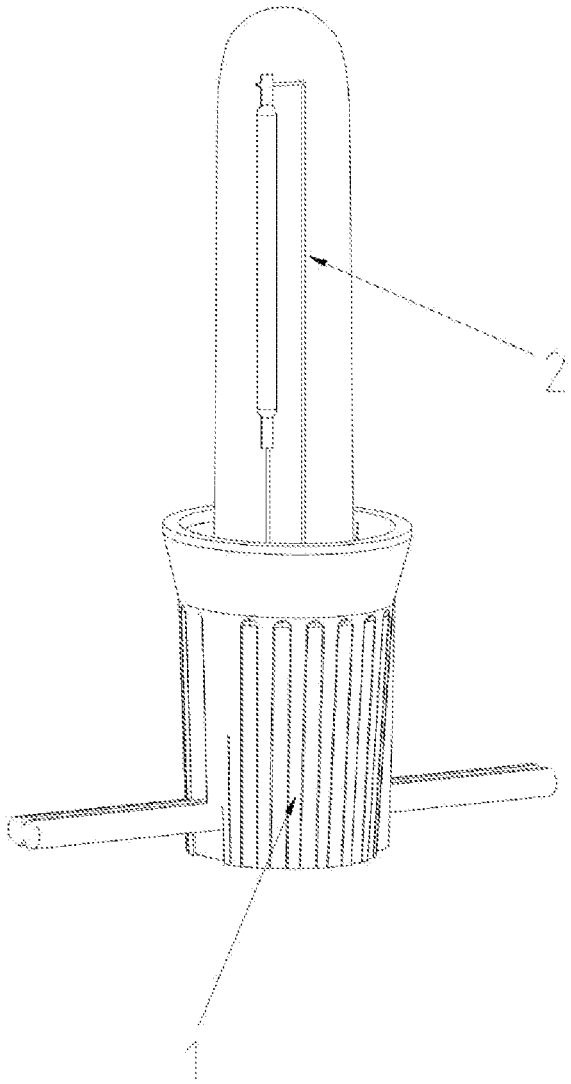
FIG. 2 is a schematic structural diagram of an inner lamp holder and a bulb of the present disclosure.

1: inner lamp holder; 2: bulb; 3: live conductor wire; 4: outer lamp holder; 41: first housing; 411: positioning ring; 412: buckling position; 413: first positioning block; 414: plugging position; 415: gap; 42: second housing; 421: buckling tongue; 422: annular assembling portion; 423: first clamping position; 424: plug connector; 5: accommodating position; 51: stopper; 52: opening; 53: threaded portion; 6: wire accommodating channel; 7: first semicircular slot; 71: second positioning block; 8: second semicircular slot; 81: second clamping position; 9: suspension loop; and 10: outer bulb shell.

DETAILED DESCRIPTION OF THE EMBODIMENTS

The present disclosure is described in detail below in combination of FIG. 1-FIG. 6.

The present disclosure discloses a split type single-buckle lamp, including an inner lamp holder 1, and a bulb 2 in threaded connection with the inner lamp holder 1. The inner lamp holder 1 is connected with a live conductor wire 3. A split type outer lamp holder 4 sleeves the inner lamp holder 1. The outer lamp holder 4 includes a first housing 41 and a second housing 42 which are buckled with each other. A positioning ring 411 for assisting in housing buckling is arranged at an upper end portion of the first housing 41. A buckling position 412 is arranged in the middle of a lower end of the first housing 41. A buckling tongue 421 matched with the buckling position 412 is arranged in the middle of a lower end of the second housing 42. The first housing 41 and the second housing 42 are connected in a single-buckle manner through the buckling tongue 421 and the buckling position 412, and the first housing 41 and the second housing 42 are buckled with each other to form an accommodating position 5 used for accommodating the inner lamp holder, and a wire accommodating channel 6 for allowing the live conductor wire 3 to pass; the split type single-buckle lamp further includes an outer bulb shell 10; the outer bulb shell 10 sleeves the bulb 2; and the outer bulb shell 10 is connected to the outer lamp holder 4.

The outer lamp holder 4 of the present disclosure is of a split type structure. If it is broken, the outer lamp holder 4 can be removed for replacement. The outer lamp holder 4 has high flexibility and will not significantly increase the use cost of the lamp and not cause a waste of parts of the lamp. Then, the positioning ring 411 used for positioning the second housing 42 is arranged at the top of the first housing 41, so that the second housing 42 can be quickly positioned, which significantly improves the assembling efficiency of the outer lamp holder 4. Furthermore, the first housing 41 and the second housing 42 are only assembled by the single-buckle device at the bottom, so that the connected structure is simple. The single-buckle device is combined with the positioning ring 411, so that the first housing 41 and the second housing 42 are connected firmly. On the other hand, the lamp adopts two lamp holders. A metal copper sleeve inside the outer lamp holder 4 is directly replaced with the inner lamp holder 1, so that the lamp holder can be connected to the bulb 2 with a small-sized lamp cap, which saves the power consumption of a string light and can also save metal materials inside the lamp holder and reduce the production cost.

In the technical solution, the positioning ring 411 integrally formed at the top end of the first housing 41 has a relatively small thickness, so that the positioning ring 411 has certain plasticity. After the outer bulb shell 10 is connected to the outer lamp holder 4, the outer bulb shell 10 tightly abuts against the positioning ring 411 to seal the end of the accommodating position 5 provided with the opening 52, so that external water cannot enter the lamp from the opening 52 of the accommodating position 5, which effectively improves the waterproof performance of the lamp.

As a preference, an annular assembling portion 422 is arranged at an upper end of the second housing 42, and the annular assembling portion 422 is of a structure having a narrow top and a wide bottom. During assembling of the outer lamp holder 4, the entire annular assembling portion 422 is assembled into the positioning ring 411 to quickly position the second housing 42 and improve the assembling efficiency. Furthermore, since the entire annular assembling portion 422 is assembled into the positioning ring 411, the annular assembling portion 422 has an effect of assisting in fixing the second housing 42, and the annular assembling portion 422 can be combined with the single-buckle device at the bottom to improve the assembling firmness.

As a further improved technical solution, a plurality of groups of first positioning blocks 413 are symmetrically arranged at a side portion of the first housing 41; and a plurality of first clamping positions 423 matched with the first positioning blocks 413 are arranged at a side portion of the second housing 42. After the annular assembling portion 422 basically positions the second housing 42, the inventor further arranges positioning structures at two side portions of the first housing 41 and the second housing, to assist in precisely positioning the side portions of the two housings. When the various first positioning blocks 413 are not aligned with the first clamping positions 423, the two housings cannot be assembled or are assembled incompletely.

As a further improved technical solution, plug connectors 424 are further arranged on two sides of the buckling tongue 421, and plugging positions 414 into which the plug connectors 424 are plugged are correspondingly arranged on two sides of the buckling position 412. The plug connectors 424 have effects of improving the connecting strength and improving the structural firmness.

In the technical solution, two sides of the first housing 41 outwards extend to form first semicircular slots 7 with openings; two sides of the second housing 42 outwards extend to form second semicircular slots 8 with openings; and both the first semicircular slots 7 and the second semicircular slots 8 are communicated with the accommodating position 5. After the first housing 41 and the second housing 42 are buckled with each other, the first semicircular slots 7 and the second semicircular slots 8 cooperate with each other to form the wire accommodating channel 6, so that the live conductor wire 3 is threaded out of the lamp holders from both sides, and at the same time, the live conductor wire 3 is limited. The beautiful degree of the lamp is improved, and the sense of abruptness caused by the fact that the conductor wire is threaded out of the lamp holders is reduced.

As a further improved technical solution, a group of second positioning blocks 71 are symmetrically arranged at the first semicircular slots 7; and a group of second clamping positions 81 matched with the second positioning blocks 71 are correspondingly arranged at the second semicircular slots 8. The second positioning blocks 71 have a positioning effect. The semicircular slots can be successfully assembled only when the second positioning blocks 71 are aligned with the second clamping positions 81.

As an embodiment, a plurality of stoppers 51 used for limiting a position of the inner lamp holder 1 are arranged on an inner wall of the accommodating position 5. According to FIG. 5 and FIG. 6, it can be known that the plurality of stoppers 51 are uniformly distributed on inner walls of the first housing 41 and the second housing 42. When the inner lamp holder 1 is put into the accommodating position 5, the symmetrically arranged stoppers 51 form a small-sized stop slot to limit the position of the inner lamp holder 1. The stoppers 51 are of sheet-like structures, so as to save the production cost.

In order to further improve the practicability of the lamp, a suspension loop 9 for suspending and positioning the bulb 2 is further arranged at a bottom end of the first housing 41. Due to the suspension loop 9, the lamp can be suspended and positioned at more outdoor scenarios, for example, a tree and a wall, so that the application range of the lamp is expanded.

In the technical solution, the suspension loop 9 partially protrudes out of the first housing 41, and the second housing 42 is correspondingly provided with a gap 415 used for accommodating the suspension loop 9. By this setting manner, after the first housing 41 and the second housing 42 are assembled, the positioning ring 411 is always located at a center of the bottom of the outer lamp holder 4, so that during suspension, the lamp will not tilt towards one side, and the lamp has a better decorative effect. Meanwhile, the gap 415 is convenient for unbuckling the corresponding buckle with a tool, so that it is convenient to maintain the lamp and replace the outer lamp holder 4.

Figure 3:
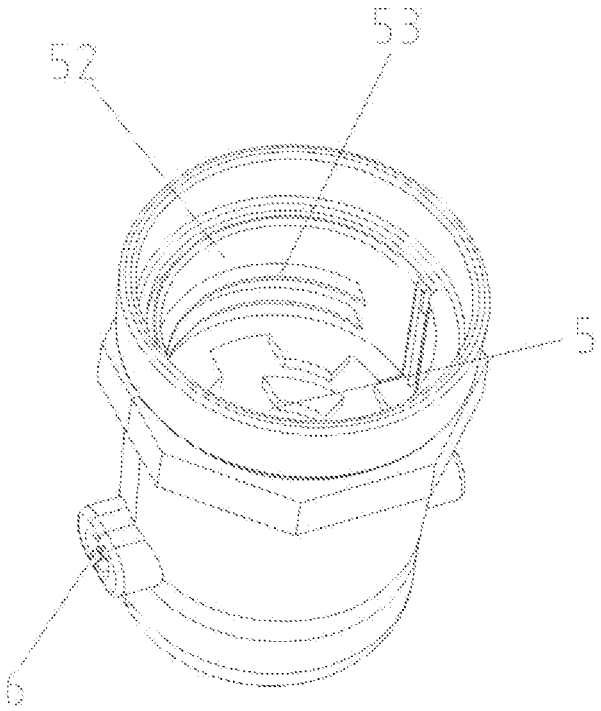
FIG. 3 is a schematic structural diagram of an outer lamp holder of the present disclosure.
Figure 4:
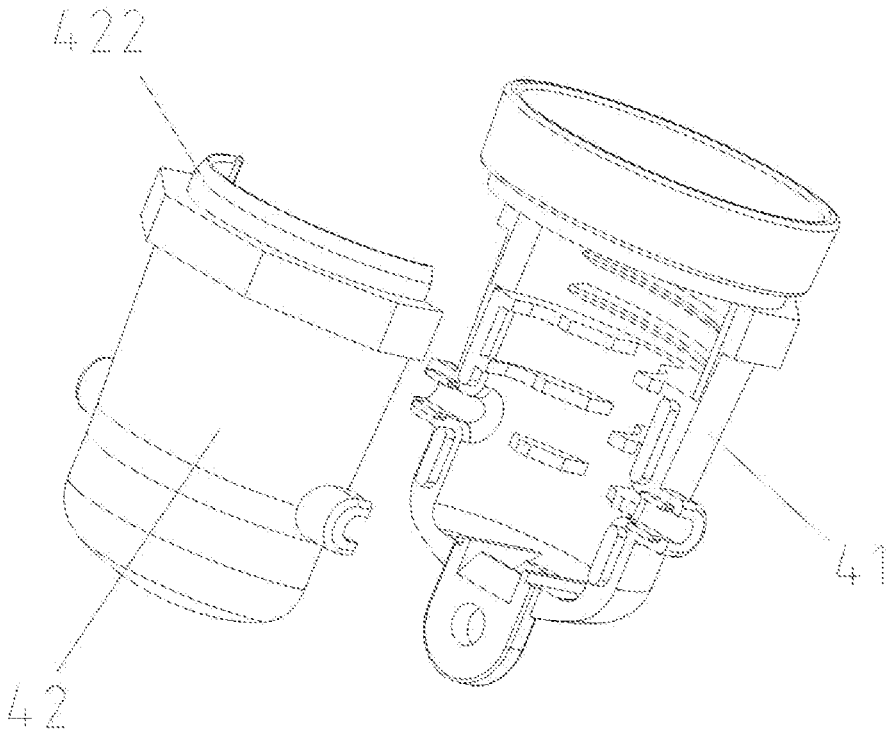
FIG. 4 is a schematic exploded structural diagram of an outer lamp holder of the present disclosure.
Figure 5:
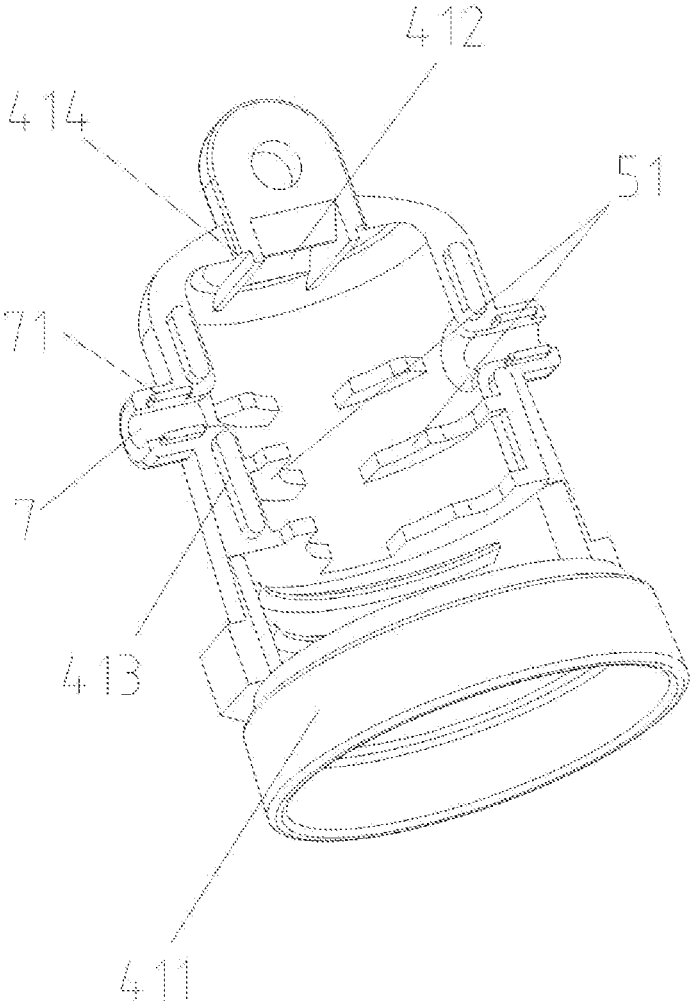
FIG. 5 is a schematic structural diagram of a first housing of the present disclosure.
Figure 6:
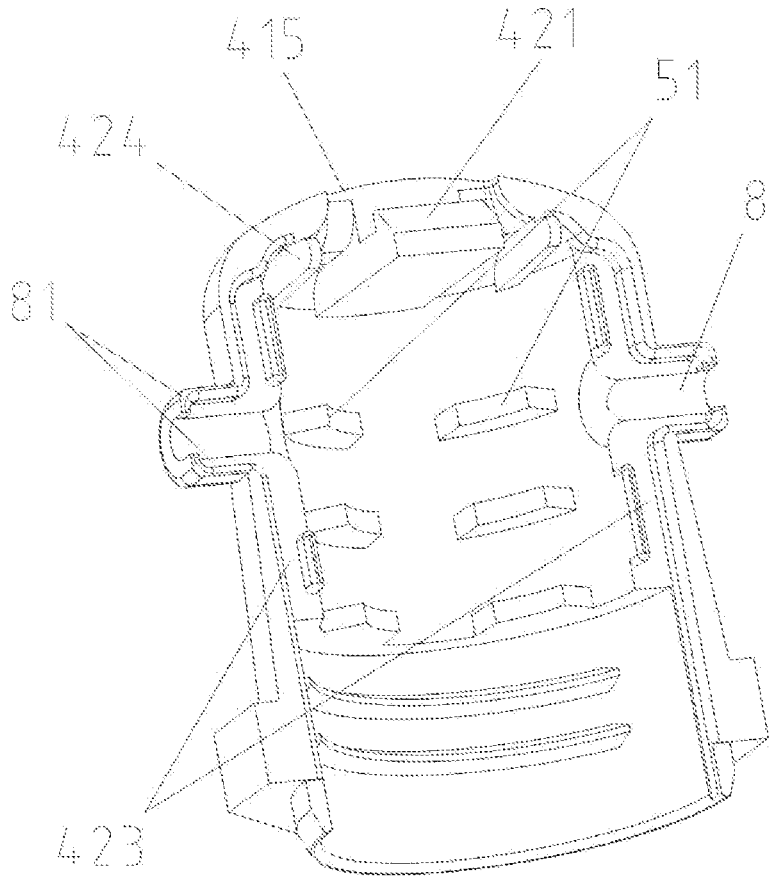
FIG. 6 is a schematic structural diagram of a second housing of the present disclosure.

As shown in FIG. 3, an opening 52 through which the bulb 2 is placed is formed in the accommodating position 5; a threaded portion 53 is arranged at the end of the accommodating position 5 provided with the opening 52; and the outer bulb shell 10 is in threaded connection with the outer lamp holder 4 through the threaded portion 53. After the bulb 2 is sleeved with the outer bulb shell 10, a unique sense of beauty is achieved by lighting up the bulb 2, which effectively improves the decorative effect of the lamp. Meanwhile, the outer bulb shell 10 can protect the bulb 2 inside to prolong the service life of the lamp.

The above contents are only preferred embodiments of the present disclosure. Those of ordinary skill in the art can make changes to the specific implementations and application scopes according to the idea of the present disclosure, and the contents of this specification shall not be understood as restrictions to the present disclosure.

What is claimed is:

1. A split type single-buckle lamp, comprising an inner lamp holder (1), and a bulb (2) in threaded connection with the inner lamp holder (1), wherein the inner lamp holder (1) is connected with a live conductor wire (3); a split type outer lamp holder (4) sleeves the inner lamp holder (1); the outer lamp holder (4) comprises a first housing (41) and a second housing (42) which are buckled with each other; a positioning ring (411) for assisting in housing buckling is arranged at an upper end portion of the first housing (41); a buckling position (412) is arranged in the middle of a lower end of the first housing (41); a buckling tongue (421) matched with the buckling position (412) is arranged in the middle of a lower end of the second housing (42); the first housing (41) and the second housing (42) are buckled with each other to form an accommodating position (5) used for accommodating the inner lamp holder, and a wire accommodating channel (6) for allowing the live conductor wire (3) to pass; the split type single-buckle lamp further comprises an outer bulb shell (10); the outer bulb shell (10) sleeves the bulb (2); and the outer bulb shell (10) is connected to the outer lamp holder (4).

2. The split type single-buckle lamp according to claim 1, wherein an annular assembling portion (422) is arranged at an upper end of the second housing (42); and the annular assembling portion (422) is of a structure having a narrow top and a wide bottom.

3. The split type single-buckle lamp according to claim 1, wherein a plurality of groups of first positioning blocks (413) are symmetrically arranged at a side portion of the first housing (41); and a plurality of first clamping positions (423) matched with the first positioning blocks (413) are arranged at a side portion of the second housing (42).

4. The split type single-buckle lamp according to claim 1, wherein plug connectors (424) are further arranged on two sides of the buckling tongue (421); and plugging positions (414) into which the plug connectors (424) are plugged are correspondingly arranged on two sides of the buckling position (412).

5. The split type single-buckle lamp according to claim 1, wherein two sides of the first housing (41) outwards extend to form first semicircular slots (7) with openings; two sides of the second housing (42) outwards extend to form second semicircular slots (8) with openings; both the first semicircular slots (7) and the second semicircular slots (8) are communicated with the accommodating position (5); and the first semicircular slots (7) and the second semicircular slots (8) cooperate with each other to form the wire accommodating channel (6).

6. The split type single-buckle lamp according to claim 5, wherein a group of second positioning blocks (71) are symmetrically arranged at the first semicircular slots (7); and a group of second clamping positions (81) matched with the second positioning blocks (71) are correspondingly arranged at the second semicircular slots (8).

7. The split type single-buckle lamp according to claim 1, wherein a plurality of stoppers (51) used for limiting a position of the inner lamp holder (1) are arranged on an inner wall of the accommodating position (5).

8. The split type single-buckle lamp according to claim 1, wherein a suspension loop (9) for suspending and positioning the bulb (2) is further arranged at a bottom end of the first housing (41).

9. The split type single-buckle lamp according to claim 8, wherein the suspension loop (9) partially protrudes out of the first housing (41), and the second housing (42) is correspondingly provided with a gap (415) used for accommodating the suspension loop (9).

10. The split type single-buckle lamp according to claim 1, wherein an opening (52) through which the bulb (2) is placed is formed in the accommodating position (5); a threaded portion (53) is arranged at the end of the accommodating position (5) provided with the opening (52); and the outer bulb shell (10) is in threaded connection with the outer lamp holder (4) through the threaded portion (53).

* * * * *